US009802092B2

(12) United States Patent
Repasky, Jr.

(10) Patent No.: US 9,802,092 B2
(45) Date of Patent: Oct. 31, 2017

(54) GOLF CLUB CLEANING DEVICE

(71) Applicant: John Repasky, Jr., Sayre, PA (US)

(72) Inventor: John Repasky, Jr., Sayre, PA (US)

( * ) Notice: Subject to any disclaimer, the term of this patent is extended or adjusted under 35 U.S.C. 154(b) by 46 days.

(21) Appl. No.: 14/992,086

(22) Filed: Jan. 11, 2016

(65) Prior Publication Data

US 2017/0197123 A1 Jul. 13, 2017

(51) Int. Cl.
*A63B 57/60* (2015.01)
*A46B 11/00* (2006.01)
*B08B 1/00* (2006.01)

(52) U.S. Cl.
CPC ..... *A63B 57/60* (2015.10); *A46B 11/0024* (2013.01); *B08B 1/006* (2013.01)

(58) Field of Classification Search
CPC combination set(s) only.
See application file for complete search history.

(56) References Cited

U.S. PATENT DOCUMENTS 2,284,952 A 6/1942 Duey
3,350,736 A 11/1967 Frazelle et al.
3,982,298 A * 9/1976 Ota ..... A47L 23/10 15/106
4,464,072 A 8/1984 Norwell
5,009,327 A 4/1991 Levison
5,075,918 A * 12/1991 Zeltner ..... A47L 13/16 15/114
5,213,430 A 5/1993 Pandola
5,349,715 A * 9/1994 Lewis, Jr. ..... A46B 3/00 15/114
D374,990 S 10/1996 Torkelson
D417,961 S * 12/1999 Powis, Jr. ..... D4/127
D426,606 S 6/2000 Jones
D439,746 S 4/2001 Lewis, Jr.
6,434,777 B1 8/2002 Sutton
9,162,125 B1 * 10/2015 McBryde ..... A46B 5/0008
2012/0272467 A1 11/2012 Forbes

FOREIGN PATENT DOCUMENTS

WO WO2008032301 3/2008

* cited by examiner

*Primary Examiner* — David Walczak

(57) ABSTRACT

A golf club cleaning device for cleaning golf clubs includes a panel that comprises cloth. A slot is positioned adjacent to a bottom edge of the panel. A plurality of first fasteners is coupled to a front of the panel adjacent to a fringe of the slot. A housing that is complementary to the slot has a plurality of bristles that is coupled to and extends transversely from a back face of the housing. The bristles are configured to engage a face of a golf club to dislodge debris. A plurality of second fasteners, which is complementary to the first fasteners, is coupled to and extends outwardly from a rim of the back face of the housing. The second fasteners are positioned to reversibly couple with the first fasteners to secure the housing to the panel.

17 Claims, 5 Drawing Sheets

GOLF CLUB CLEANING DEVICE

BACKGROUND OF THE DISCLOSURE

Field of the Disclosure

The disclosure relates to cleaning devices and more particularly pertains to a new cleaning device for cleaning golf clubs.

SUMMARY OF THE DISCLOSURE

An embodiment of the disclosure meets the needs presented above by generally comprising a panel that comprises cloth. A slot is positioned adjacent to a bottom edge of the panel. A plurality of first fasteners is coupled to a front of the panel adjacent to a fringe of the slot. A housing that is complementary to the slot has a plurality of bristles that is coupled to and extends transversely from a back face of the housing. The bristles are configured to engage a face of a golf club to dislodge debris. A plurality of second fasteners, which is complementary to the first fasteners, is coupled to and extends outwardly from a rim of the back face of the housing. The second fasteners are positioned to reversibly couple with the first fasteners to secure the housing to the panel.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
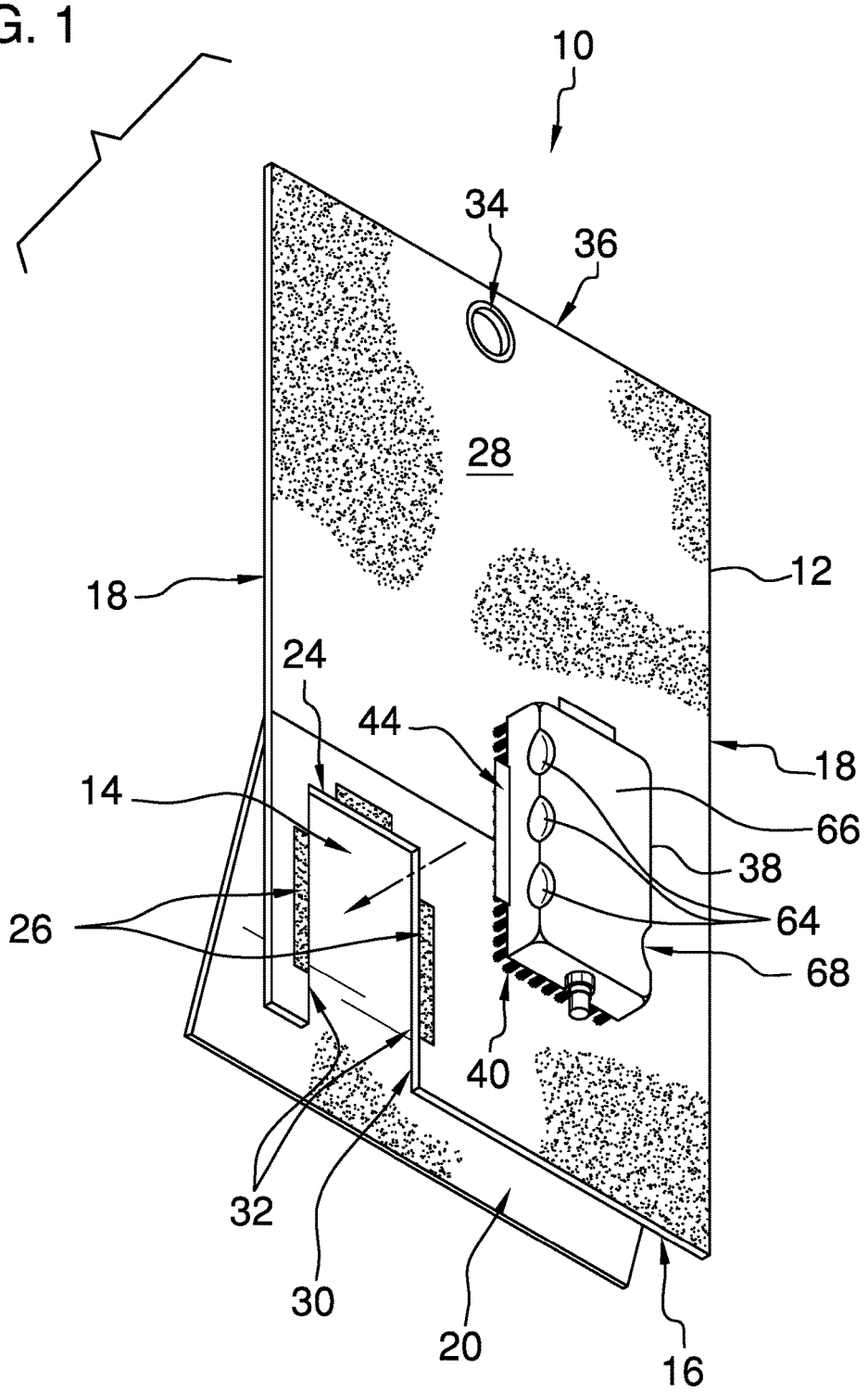
FIG. 1 is an isometric perspective view of a golf club cleaning device according to an embodiment of the disclosure.
Figure 2:
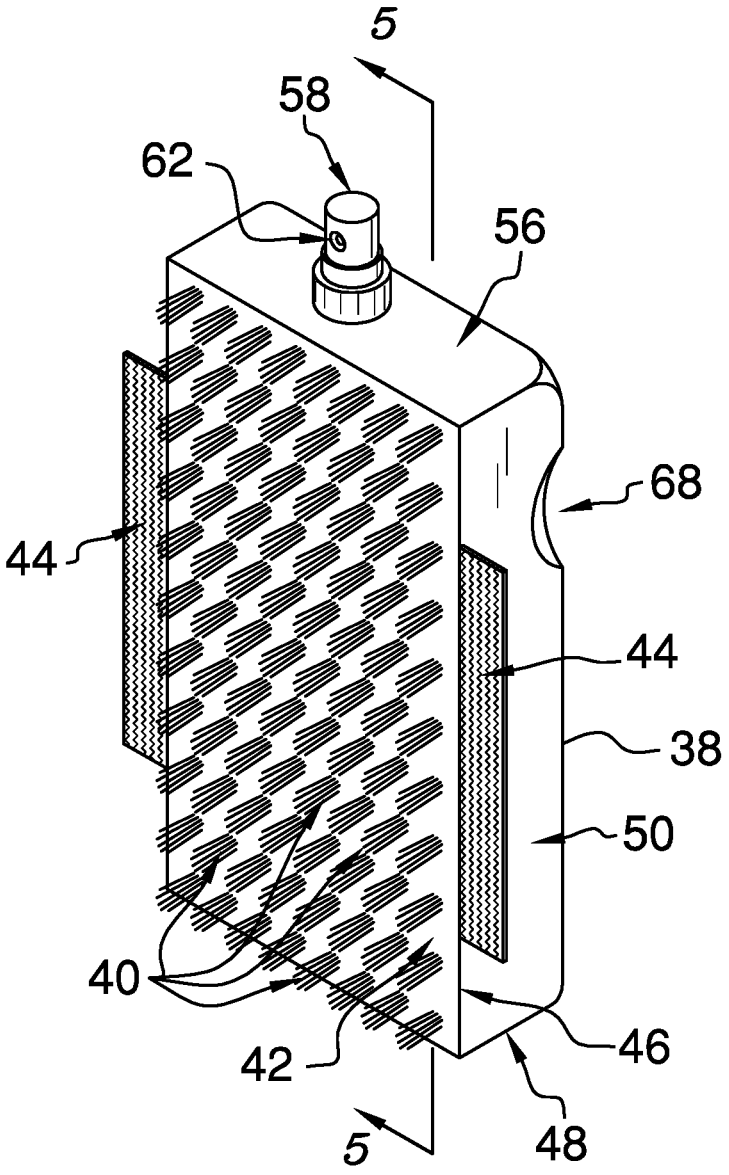
FIG. 2 is an isometric perspective of an embodiment of the disclosure.
Figure 3:
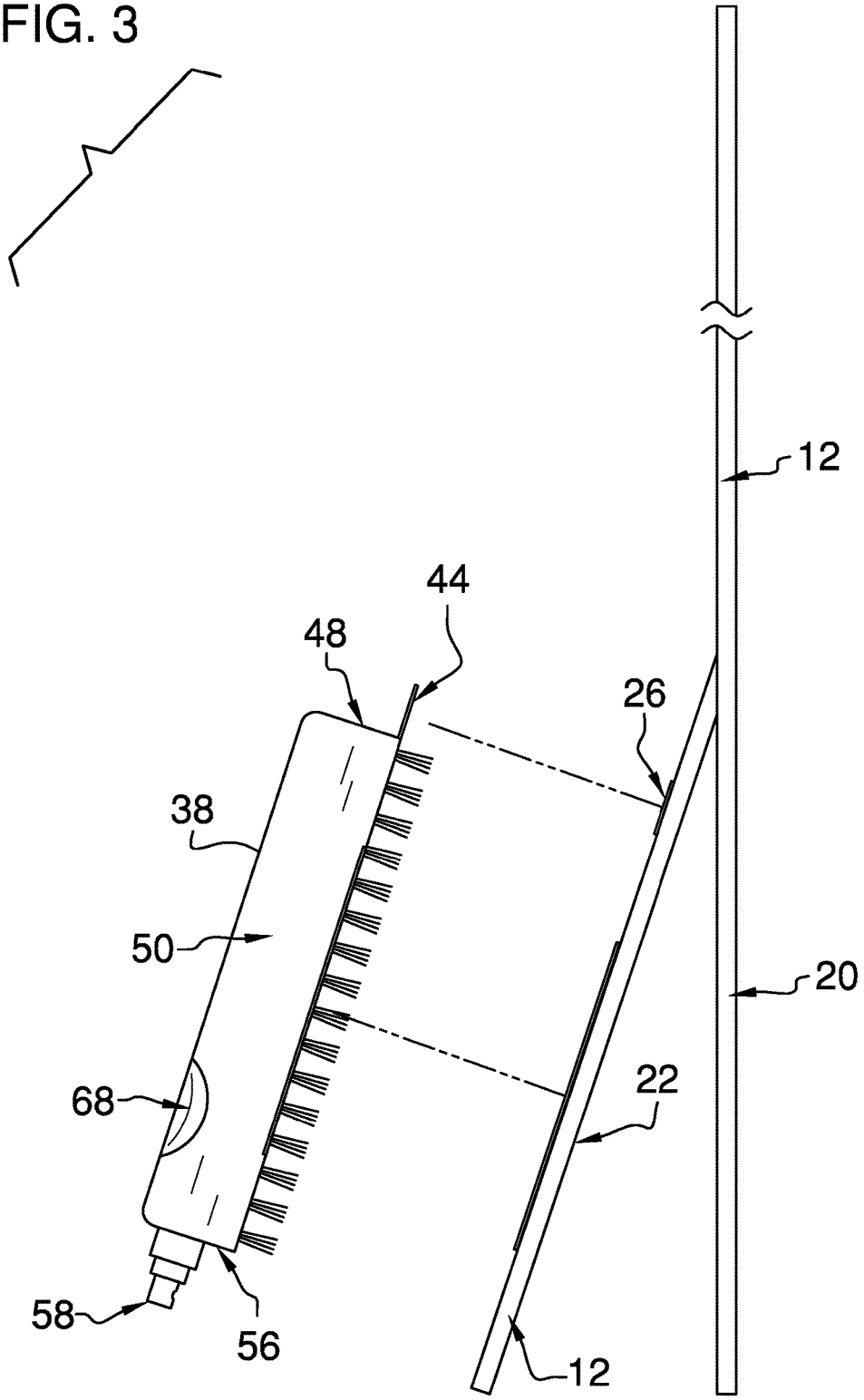
FIG. 3 is a side view of an embodiment of the disclosure.
Figure 4:
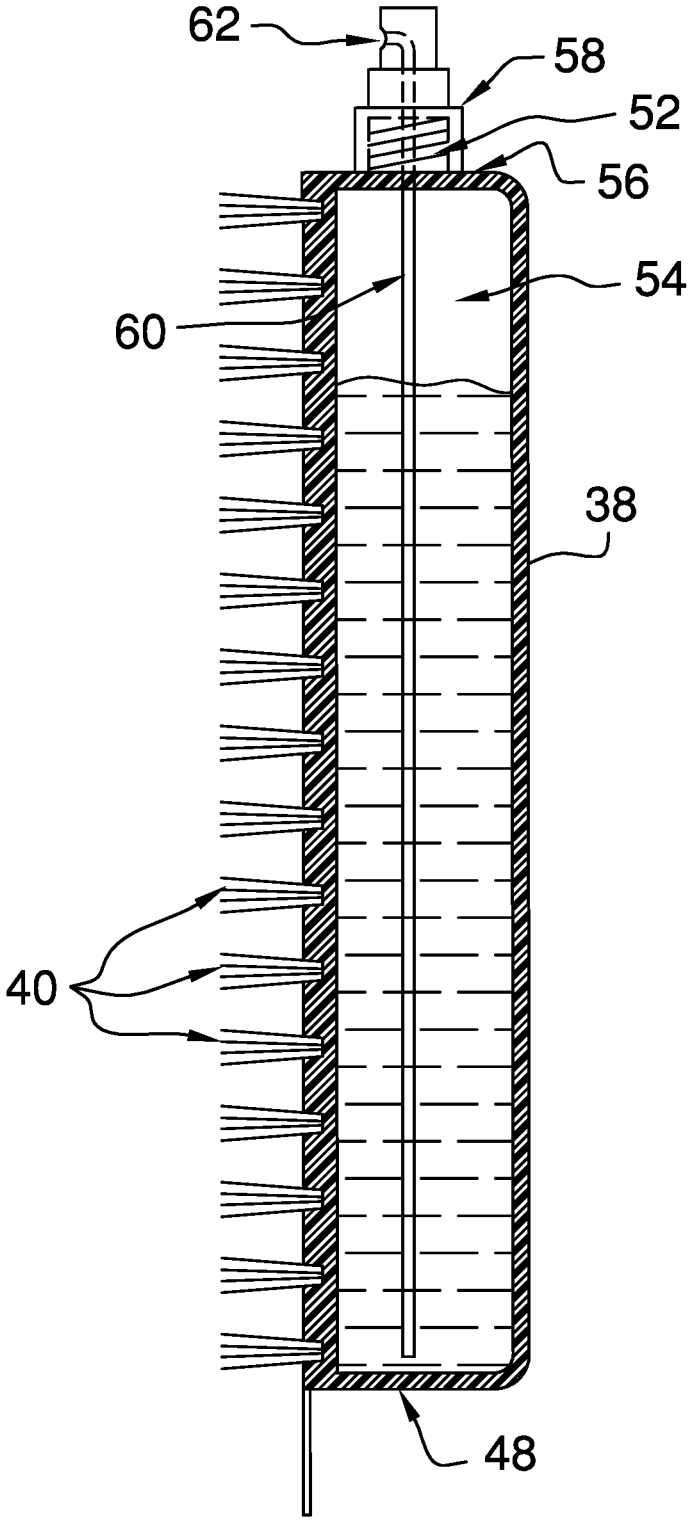
FIG. 4 is a cross-sectional view of an embodiment of the disclosure.
Figure 5:
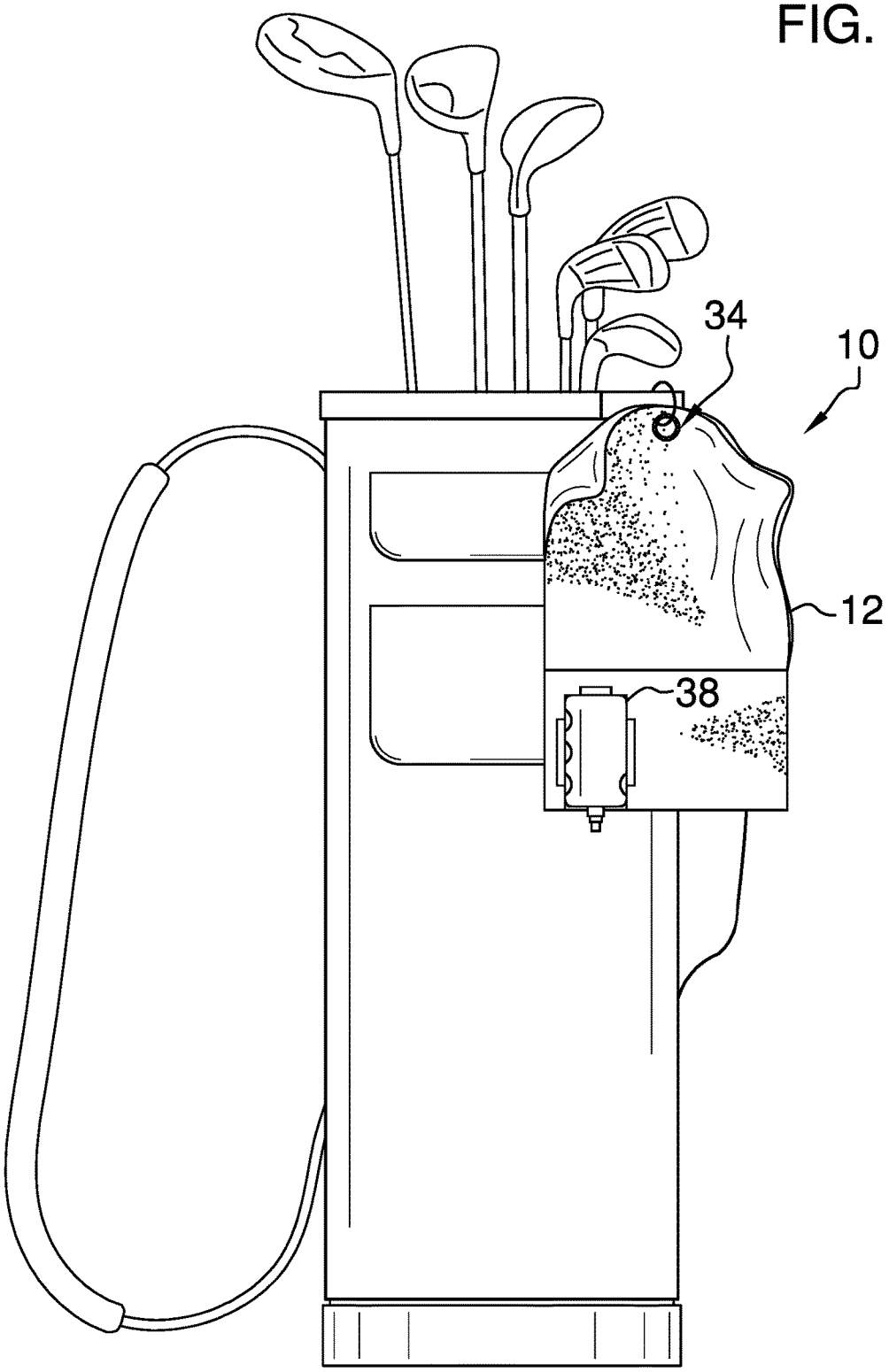
FIG. 5 is an in-use view of an embodiment of the disclosure.

With reference now to the drawings, and in particular to FIGS. 1 through 5 thereof, a new cleaning device embodying the principles and concepts of an embodiment of the disclosure and generally designated by the reference numeral 10 will be described.

As best illustrated in FIGS. 1 through 5, the golf club cleaning device 10 generally comprises a panel 12 that comprises cloth. A slot 14 is positioned adjacent to a bottom edge 16 of the panel 12. The panel 12 and the slot 14 are substantially rectangularly shaped. Preferably, the slot 14 is positioned proximate to a respective opposing side edge 18 of the panel 12.

An extension 20 may be coupled to a back 22 of the panel 12 proximate to a top side 24 of the slot 14. The extension 20 extends between the opposing side edges 18 of the panel 12 and to proximate to the bottom edge 16 of the panel 12. The extension 20 comprises cloth.

A plurality of first fasteners 26 is coupled to a front 28 of the panel 12 adjacent to a fringe 30 of the slot 14. Preferably, the plurality of first fasteners 26 comprises three first fasteners 26 coupled singly to the top side 24 and opposing sides 32 of the slot 14.

A grommet 34 is positioned through the panel 12, such that the grommet 34 is configured to hang the panel 12 from a golf bag. Preferably, the grommet 34 is positioned proximate to a top edge 36 of the panel 12.

The device 10 comprises a housing 38 that is complementary to the slot 14. A plurality of bristles 40 is coupled to and extends transversely from a back face 42 of the housing 38. The bristles 40 are configured to engage a face of a golf club to dislodge debris. Preferably, the bristles 40 comprise nylon.

A plurality of second fasteners 44, which is complementary to the first fasteners 26, is coupled to and extends outwardly from a rim 46 of the back face 42. The second fasteners 44 are positioned to reversibly couple with the first fasteners 26 to secure the housing 38 to the panel 12. Preferably, the plurality of second fasteners 44 comprises three second fasteners 44 coupled singly to the rim 46 adjacent to a lower face 48 and opposing side faces 50 of the housing 38. The first fasteners 26 and the second fasteners 44 are selected from the group of fasteners consisting of hook-type and loop-type fasteners.

A neck 52 is coupled to the housing 38. The neck 52 is fluidically connected to an interior space 54 defined by the housing 38. Preferably, the neck 52 is coupled to an upper face 56 of the housing 38. A spray cap 58 is threadedly couplable to the neck 52. A dipstick 60, which is fluidically connected to the spray cap 58, extends from the spray cap 58 into the interior space 54. The spray cap 58 is configured to be depressed by a user such that liquid positioned in the interior space 54 is drawn through the dipstick 60 and discharged through an orifice 62 positioned in the spray cap 58. Preferably, the dipstick 60 extends from the spay cap 58 to proximate to the lower face 48 of the housing 38.

Each of a plurality of indentations 64 is positioned in a respective opposing side face 50 of the housing 38 and extends into a front face 66 of the housing 38. Preferably, the plurality of indentations 64 comprises three indentations 64 substantially evenly spaced along the respective opposing side face 50. A depression 68 is positioned in a respective opposing side face 50 of the housing 38 and extends into the front face 66 of the housing 38. The depression 68 is in opposition to the indentations 64. The indentations 64 and the depression 68 are positioned in the housing 38 such that three fingers and a thumb of a user's hand are positionable around the housing 38. Preferably, the indentations 64 and the depression 68 are arcuate.

In use, the grommet 34 is configured to secure the panel 12 to a user's golf bag. The housing 38 is detachable from the panel 12 by decoupling of the first fasteners 26 from the second fasteners 44. Cleaning fluid positioned in the interior space 54 of the housing 38 is discharged using the spray cap 58, and the bristles 40 positioned on the back face 42 of the housing 38 are configured to dislodge debris from the face of the user's golf clubs. The panel 12, comprising cloth, is configured for drying the golf clubs.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A golf club cleaning device comprising:

a panel, said panel comprising cloth;

a slot, said slot being positioned adjacent to a bottom edge of said panel;

a plurality of first fasteners, said first fasteners being coupled to a front of said panel adjacent to a fringe of said slot;

a housing, said housing being complementary to said slot;

a plurality of bristles, said bristles being coupled to and extending transversely from a back face of said housing, wherein said bristles are configured to engage a face of a golf club to dislodge debris;

a plurality of second fasteners, said second fasteners being complementary to said first fasteners, said second fasteners being coupled to and extending outwardly from a rim of said back face, wherein said second fasteners are positioned to reversibly couple with said first fasteners to secure said housing to said panel, said first fasteners and said second fasteners being selected from the group of fasteners consisting of hook-type and loop-type fasteners.

2. The device of claim 1, further including said panel being substantially rectangularly shaped.

3. The device of claim 1, further including said slot being substantially rectangularly shaped.

4. The device of claim 1, further including said slot being positioned proximate to a respective opposing side edge of said panel.

5. The device of claim 1, further including an extension, said extension being coupled to a back of said panel proximate to a top side of said slot, said extension extending between opposing side edges of said panel.

6. The device of claim 5, further including said extension extending to proximate to said bottom edge of said panel.

7. The device of claim 5, further including said extension comprising cloth.

8. The device of claim 1, further including a grommet, said grommet being positioned through said panel, wherein said grommet is configured for hanging said panel from a golf bag.

9. The device of claim 8, further including said grommet being positioned proximate to a top edge of said panel.

10. The device of claim 1, further including said bristles comprising nylon.

11. The device of claim 1, further comprising:

said plurality of first fasteners comprising three first fasteners coupled singly to a top side and opposing sides of said slot; and said plurality of second fasteners comprising three second fasteners coupled singly to said rim adjacent to a lower face and opposing side faces of said housing.

12. A golf club cleaning device comprising:

a panel, said panel comprising cloth;

a slot, said slot being positioned adjacent to a bottom edge of said panel;

a plurality of first fasteners, said first fasteners being coupled to a front of said panel adjacent to a fringe of said slot;

a housing, said housing being complementary to said slot;

a plurality of bristles, said bristles being coupled to and extending transversely from a back face of said housing, wherein said bristles are configured to engage a face of a golf club to dislodge debris;

a plurality of second fasteners, said second fasteners being complementary to said first fasteners, said second fasteners being coupled to and extending outwardly from a rim of said back face, wherein said second fasteners are positioned to reversibly couple with said first fasteners to secure said housing to said panel;

a neck, said neck being coupled to said housing, said neck being fluidically connected to an interior space defined by said housing;

a spray cap, said spray cap being threadedly couplable to said neck;

a dipstick, said dipstick being fluidically connected to said spray cap, said dipstick extending from said spray cap into said interior space; and wherein said spray cap is configured to be depressed by a user such that liquid positioned in said interior space is drawn through said dipstick and discharged through an orifice positioned in said spray cap.

13. The device of claim 12, further comprising:

said neck being coupled to an upper face of said housing; and said dipstick extending from said spay cap to proximate to a lower face of said housing.

14. A golf club cleaning device comprising:

a panel, said panel comprising cloth;

a slot, said slot being positioned adjacent to a bottom edge of said panel;

a plurality of first fasteners, said first fasteners being coupled to a front of said panel adjacent to a fringe of said slot;

a housing, said housing being complementary to said slot;

a plurality of bristles, said bristles being coupled to and extending transversely from a back face of said housing, wherein said bristles are configured to engage a face of a golf club to dislodge debris;

a plurality of second fasteners, said second fasteners being complementary to said first fasteners, said second fasteners being coupled to and extending outwardly from a rim of said back face, wherein said second fasteners are positioned to reversibly couple with said first fasteners to secure said housing to said panel;

a plurality of indentations, each of said indentations being positioned in a respective opposing side face of said housing and extending into a front face of said housing; and a depression, said depression being positioned in a respective opposing side face of said housing and extending into said front face of said housing, said depression being in opposition to said indentations.

15. The device of claim 14, further including said plurality of indentations comprising three indentations substantially evenly spaced along said respective said opposing side face wherein said indentations and said depression are positioned in said housing such that three fingers and a thumb of a user's hand are positionable around said housing.

16. The device of claim 14, further including said indentations and said depression being arcuate.

17. The device of claim 1, further comprising:

said panel being substantially rectangularly shaped;

said slot being substantially rectangularly shaped, said slot being positioned proximate to a respective opposing side edge of said panel;

an extension, said extension being coupled to a back of said panel proximate to a top side of said slot, said extension extending between opposing side edges of said panel, said extension extending to proximate to said bottom edge of said panel, said extension comprising cloth;

said plurality of first fasteners comprising three first fasteners coupled singly to a top side and opposing sides of said slot;

a grommet, said grommet being positioned through said panel, wherein said grommet is configured for hanging said panel from a golf bag, said grommet being positioned proximate to a top edge of said panel;

said bristles comprising nylon;

said plurality of second fasteners comprising three second fasteners coupled singly to said rim adjacent to a lower face and opposing side faces of said housing;

a neck, said neck being coupled to said housing, said neck being fluidically connected to an interior space defined by said housing, said neck being coupled to an upper face of said housing;

a spray cap, said spray cap being threadedly couplable to said neck;

a dipstick, said dipstick being fluidically connected to said spray cap, said dipstick extending from said spray cap into said interior space, wherein said spray cap is configured to be depressed by a user such that liquid positioned in said interior space is drawn through said dipstick and discharged through an orifice positioned in said spray cap, said dipstick extending from said spay cap to proximate to said lower face of said housing;

a plurality of indentations, each of said indentations being positioned in a respective said opposing side face of said housing and extending into a front face of said housing, said plurality of indentations comprising three indentations substantially evenly spaced along said respective said opposing side face, said indentations being arcuate;

a depression, said depression being positioned in a respective said opposing side face of said housing and extending into said front face of said housing, said depression being in opposition to said indentations, wherein said indentations and said depression are positioned in said housing such that three fingers and a thumb of a user's hand are positionable around said housing, said depression being arcuate.

* * * * *